US008110532B2

(12) United States Patent
Dong

(10) Patent No.: US 8,110,532 B2
(45) Date of Patent: Feb. 7, 2012

(54) ANTIOXIDANT COMPOSITIONS

(75) Inventor: Jun Dong, Cheshire, CT (US)

(73) Assignee: Chemtura Corporation, Middlebury, CT (US)

( * ) Notice: Subject to any disclaimer, the term of this patent is extended or adjusted under 35 U.S.C. 154(b) by 237 days.

(21) Appl. No.: 12/277,019

(22) Filed: Nov. 24, 2008

(65) Prior Publication Data

US 2010/0130396 A1 May 27, 2010

(51) Int. Cl.
*C10M 133/12* (2006.01)
*C10M 143/00* (2006.01)
*C08K 5/13* (2006.01)

(52) U.S. Cl. ..... 508/563; 508/185; 508/585

(58) Field of Classification Search ..... 508/563, 508/585, 185
See application file for complete search history.

(56) References Cited

U.S. PATENT DOCUMENTS

| | | | | |
|---|---|---|---|---|
| 3,305,522 | A | 2/1967 | Spacht | |
| 4,360,486 | A | 11/1982 | DiBiasi et al. | |
| 5,091,099 | A | 2/1992 | Evans et al. | |
| 5,158,992 | A | 10/1992 | Caselli et al. | |
| 5,358,652 | A * | 10/1994 | Macpherson | 508/271 |
| 5,480,940 | A | 1/1996 | Khasat et al. | |
| 5,728,759 | A | 3/1998 | Pike | |
| 5,760,099 | A | 6/1998 | Horn et al. | |
| 5,869,565 | A | 2/1999 | Clauss | |
| 6,315,925 | B1 * | 11/2001 | Aebli et al. | 252/401 |
| 2003/0144395 | A1 | 7/2003 | Broussard et al. | |
| 2003/0189192 | A1 | 10/2003 | Girelli et al. | |
| 2006/0089437 | A1 * | 4/2006 | Broussard et al. | 524/317 |
| 2008/0139421 | A1 * | 6/2008 | Loper et al. | 508/151 |

FOREIGN PATENT DOCUMENTS

| | | | |
|---|---|---|---|
| EP | 0442614 | A2 | 8/1991 |
| EP | 0502520 | A1 | 9/1992 |
| EP | 1076075 | A1 | 2/2001 |
| EP | 1 669 436 | A1 | 6/2006 |
| JP | 2000 103906 | A | 4/2000 |

OTHER PUBLICATIONS

CAPLUS abstract, XP002177248, No. 2000:236136 of JP 2000 103906 (Apr. 11, 2000).

JPO abstract for JP11-116949, Akashi, et al (Apr. 27, 1999).

"Irganox® 1141 Liquid Stabilizer for ABS/MBS" (1998, Ciba Specialty Chemicals Publication No. 016256.00.040 e/CH), obtained from: http://www.specialchem4polymers.com/sf/ciba/index.aspx?id=Antioxydants.

"Irganox® 1141 Liquid Antioxidant for PVC" (1998, Ciba Specialty, Chemicals Publication No. 016272.00.040 e/CH), obtained from: http://www.specialchem4polymers.com/sf/ciba/index.aspx?id=Antioxydants.

Technical Data Sheet LOWINOX CPL (Phenolic Antioxidant) Copyright 2007 Chemtura Corporation. One page (effective Nov. 17, 2009).

* cited by examiner

*Primary Examiner* — Jim Goloboy
(74) *Attorney, Agent, or Firm* — Joseph Suhadolnik

(57) ABSTRACT

The invention relates to antioxidant compositions for lubricants and organic polymers comprising a first antioxidant comprising a reaction product of p-cresol, dicyclopentadiene and isobutylene; and a second antioxidant comprising a diarylamine. The first antioxidant preferably has the structure:

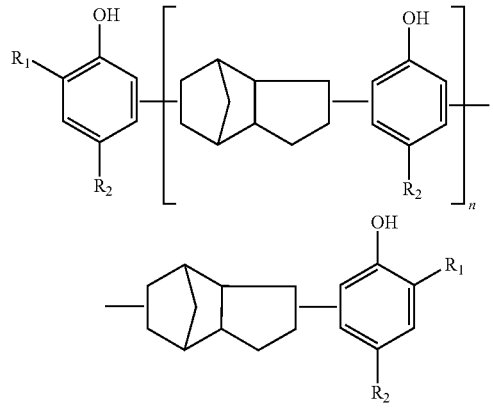

wherein n is 0-50, and $R_1$ and $R_2$ are independently hydrogen, a straight or branched $C_1$-$C_{30}$ alkyl or alkylene group optionally substituted with one or more substituents, $C_3$-$C_{12}$ cycloalkyl, $C_5$-$C_{12}$ aryl, or $C_6$-$C_{12}$ alkylaryl. The second antioxidant preferably has the formula:

$$(R_3)_a—Ar_1—NH—Ar_2—(R_4)_b$$

wherein $Ar_1$ and $Ar_2$ are independently aromatic hydrocarbon groups and $R_3$ and $R_4$ are independently hydrogen or hydrocarbyl groups having from 6 to about 100 carbon atoms and a and b are independently 0 to 3 but (a+b) is not greater than 4.

9 Claims, No Drawings

ANTIOXIDANT COMPOSITIONS

FIELD OF THE INVENTION

The present invention relates to antioxidant compositions for lubricants. More specifically, the invention relates to liquid antioxidant compositions comprising a sterically hindered phenol and a diarylamine, and their use in the stabilization of lubricants against degradation caused by oxygen, heat and/or light.

BACKGROUND OF THE INVENTION

Hydrocarbon based lubricants oxidize over time when exposed to heat and oxygen (air) that are ubiquitously present during their manufacture, transport, storage, or use. Uncontrolled oil oxidation produces harmful species, which eventually compromise the designated functionalities of the lubricant, shortens its service life and, to a more extreme extent, damages the machinery it lubricates. For the prevention of lubricant oxidation, a practical approach is to use a suitable antioxidant system, comprising of one or more active components.

Driven by escalating performance and environment requirements for many classes of lubricant products, the industry is continuously seeking high performance antioxidants to work with modern lubricant formulations in order to provide better oxidative stability, longer drain interval, improved low temperature properties, and greater fuel economy.

One notable change from the lubricant formulation point of view is the reduction in the use of zinc dialkyldithiophosphates (ZDDP). Over the past decades, ZDDP's have been an important class of lubricant additive for many types of lubricants owing to their superior cost-effectiveness in wear protection and oxidation inhibition, particularly through a synergistic action with primary antioxidants. The presence of zinc in ZDDP's, however, contributes to the formation of ash particulates in internal combustion engines, and the volatile phosphors after entering the exhaust stream poisons the $NO_x$ catalysis, both shortening the useful life of catalytic converter.

A second low ZDDP antioxidant composition is described in U.S. Pat. No. 6,559,105, the entirety of which is incorporated herein by reference, which discloses a composition of an antioxidant of the formula:

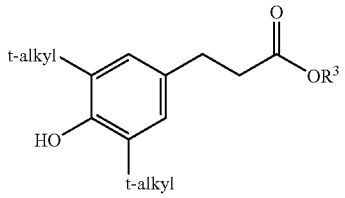

wherein $R^3$ is an alkyl group of 2 to 6 carbon atoms, and a dispersant or a detergent, is a useful additive package for lubricant compositions. Hindered phenols of the type described in the '105 patent, however, recently have been shown to decompose under high temperature oxidation conditions, thereby decreasing their antioxidant properties.

The need remains for additional antioxidant compositions, particularly for lubricant applications, having low amounts of ZDDP and high stabilizing effectiveness. The need also exists for antioxidant compositions that remain stable at high temperature oxidation conditions.

SUMMARY OF THE INVENTION

The present invention relates to low ZDDP phenolic antioxidant compositions for stabilizing lubricants. The antioxidant compositions preferably are highly stable, even under high temperature oxidation conditions. In one embodiment, for example, the invention relates to an antioxidant composition, comprising: (a) a first antioxidant having the structure:

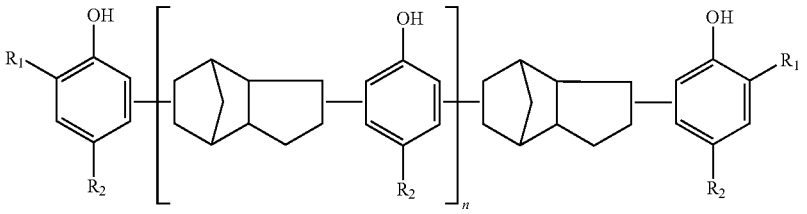

One low ZDDP antioxidant composition is described in U.S. Pat. No. 3,305,522, the entirety of which is incorporated herein by reference, which describes hindered phenolic compounds prepared by a two-step process which involves reacting one mol of dicyclopentadiene with at least one mol of a phenolic compound selected from the group consisting of phenol, para-cresol, mixed meta-para-cresol and para-ethyl phenol in the presence of a Friedel-Craft type catalyst. This reaction product is subsequently alkylated with at least one-half mol of a tertiary olefinic material per mol of dicyclopentadiene, the tertiary olefinic material being selected from the group consisting of isobutylene, tertiary hexenes and tertiary pentenes. The hindered phenolic compounds described in the '522 patent possess antioxidant properties for stabilizing organic materials such as rubber, gasoline, and oils.

wherein n is 0-50, and $R_1$ and $R_2$ are independently hydrogen, a straight or branched $C_1$-$C_{30}$ alkyl or alkylene group optionally substituted with one or more substituents, $C_3$-$C_{12}$ cycloalkyl, $C_5$-$C_{12}$ aryl, or $C_6$-$C_{12}$ alkylaryl; and (b) a second antioxidant having the formula:

$$(R_3)_a—Ar_1—NH—Ar_2—(R_4)_b$$

wherein $Ar_1$ and $Ar_2$ are independently aromatic hydrocarbon groups and $R_3$ and $R_4$ are independently hydrogen or hydrocarbyl groups having from 6 to about 100 carbon atoms and a and b are independently 0 to 3 but (a+b) is not greater than 4. The weight ratio of the second antioxidant to the first antioxidant optionally is from 1:99 to 99:1, is greater than 3:1, or is from 3:1 to 19:1. Ideally, the antioxidant composition is a liquid at 25° C., and preferably has a kinematic viscosity at 100° C. of less than 40 cSt.

Preferably, $R_1$ is tert-butyl or styrenyl optionally substituted on the α-position. $R_2$ preferably is an alkyl or alkylene group having five or fewer carbons, e.g., methyl, ethyl, propyl, butyl, or pentyl. In one preferred embodiment, the second antioxidant comprises a mixture of mono-, di- and tri-nonyl diphenylamine.

The first antioxidant optionally has the structure:

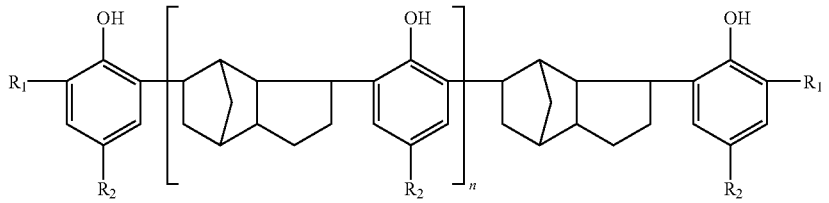

wherein $R_1$, $R_2$ and n are as defined above.

In one preferred embodiment, the antioxidant composition is substantially free of hindered phenolics of formula:

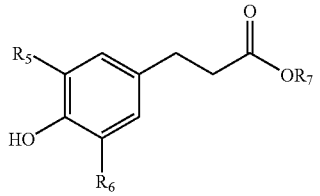

wherein $R_5$, $R_6$, and $R_7$, the same or different, represent a linear or branched $C_1$-$C_{18}$ alkyl group. For example, the composition may comprise this hindered phenolic in an amount less than 0.2 weight percent, based on the total weight of the antioxidant composition.

In another embodiment, the invention is to a lubricant composition, comprising a base stock of lubricating viscosity; and any of the above-described antioxidant compositions (e.g., comprising the above-described first and second antioxidants). In this embodiment, the lubricant composition preferably comprises the base stock in an amount from 65 to 99.9 wt. %, and the antioxidant composition in an amount from 0.05 to 3 wt. %, based on the weight of the lubricant composition. Preferably, the lubricant composition comprises ZDDP in an amount no greater than 1 wt. %, e.g., less than 0.7 wt. %, based on the total weight of the lubricant composition.

In another embodiment, the invention is to a polymer composition, comprising an organic polymer; and any of the above-described antioxidant compositions (e.g., comprising the above-described first and second antioxidants).

In another embodiment, the invention is to a lubricant composition, comprising: (a) a base stock of lubricating viscosity; and (b) an additive package, comprising: (i) a first antioxidant having the structure:

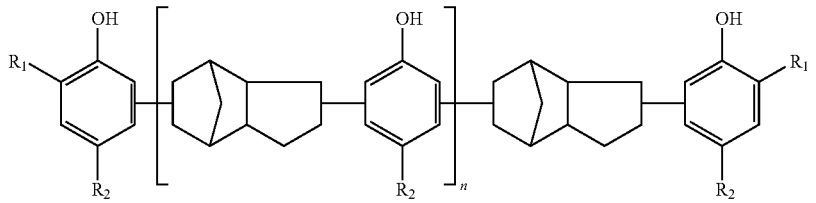

wherein n is 0-50, and $R_1$ and $R_2$ are independently hydrogen, a straight or branched $C_1$-$C_{30}$ alkyl or alkylene group optionally substituted with one or more substituents, $C_3$-$C_{12}$ cycloalkyl, $C_5$-$C_{12}$ aryl, or $C_6$-$C_{12}$ alkylaryl; and (ii) a second diarylamine antioxidant. The additive package preferably is present in the lubricant in an amount ranging from 0.1 to 3.0 weight percent, based on the weight of the lubricant.

In another embodiment, the invention is to an antioxidant composition, comprising: (a) a first antioxidant comprising a reaction product of p-cresol, dicyclopentadiene and isobutylene; and (b) a second antioxidant comprising a diarylamine. For example, the second antioxidant may comprise a mixture of mono-, di- and tri-nonyl diphenylamine. The weight ratio of the second antioxidant to the first antioxidant optionally is from 1:99 to 99:1, is greater than 3:1, or is from 3:1 to 19:1. Preferably, the antioxidant composition is a liquid at 25° C. and may have a kinematic viscosity at 100° C. of less than 40 cSt. The antioxidant composition preferably is substantially free of hindered phenolics of formula of the formula:

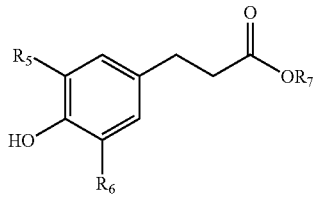

wherein $R_5$, $R_6$, and $R_7$, the same or different, represent a linear or branched $C_1$-$C_{18}$ alkyl group. For example, the composition may comprise this hindered phenolic in an amount less than 0.2 weight percent, based on the total weight of the antioxidant composition.

In another embodiment, the invention is to a lubricant composition comprising: (a) a base stock of lubricating viscosity; and (b) an antioxidant composition comprising: a first antioxidant comprising a reaction product of p-cresol, dicyclopentadiene and isobutylene, and a second antioxidant comprising a diarylamine. The lubricant composition may comprise the base stock in an amount from 65 to 99.9 wt. %, and the antioxidant composition in an amount from 0.05 to 3 wt. %, based on the weight of the lubricant composition. The weight ratio of the first antioxidant to the second antioxidant optionally is from 3:1 to 19:1. Preferably, the lubricant composition comprises ZDDP in an amount no greater than 1 wt.

%, e.g., less than 7 wt. %, based on the total weight of the lubricant composition. The lubricant composition optionally further comprises at least one lubricating oil additive selected from the group consisting of antioxidants, anti-wear agents, detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and mixtures thereof.

DETAILED DESCRIPTION OF THE INVENTION

Introduction

The present invention is directed to antioxidant compositions and lubricants incorporating such antioxidant compositions, the antioxidant compositions comprising one or more hindered phenolic compounds in combination with one or more diarylamines. The one or more hindered phenolic compounds employed in the antioxidant compositions preferably comprise the reaction products formed by reacting dicyclopentadiene with one or more of phenol, p-cresol, or p-ethyl-phenol and further nuclear alkylating the condensation product with one or more tertiary olefins, such as but not limited to, isobutylene, a tertiary hexene or a tertiary pentene. The one or more diarylamines preferably are selected from mono-nonyl diphenylamine, di-nonyl diphenylamine, tri-nonyl diphenylamine, and mixtures thereof.

In one embodiment, for example, the invention is directed to an antioxidant composition, comprising: (a) a first antioxidant having structure (I):

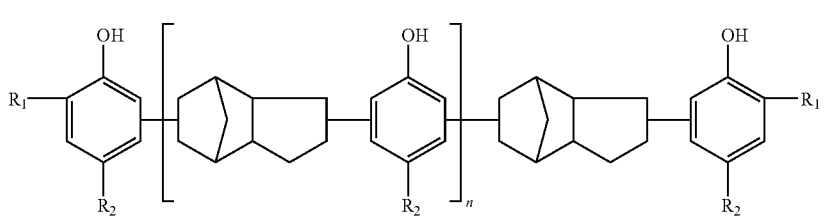

(I)

wherein n is 0-50, and $R_1$ and $R_2$ are independently hydrogen, a straight or branched $C_1$-$C_{30}$ alkyl or alkylene group optionally substituted with one or more substituents, $C_3$-$C_{12}$ cycloalkyl, $C_5$-$C_{12}$ aryl, or $C_6$-$C_{12}$ alkylaryl; and (b) a second antioxidant having structure (II):

$$(R_3)_a—Ar_1—NH—Ar_2—(R_4)_b \quad (II)$$

wherein $Ar_1$ and $Ar_2$ are independently aromatic hydrocarbon groups and $R_3$ and $R_4$ are independently hydrogen or hydrocarbyl groups having from 6 to about 100 carbon atoms and a and b are independently 0 to 3 but (a+b) is not greater than 4.

The antioxidant compositions and lubricant compositions of the invention preferably are substantially free of hindered phenolics of formula (III):

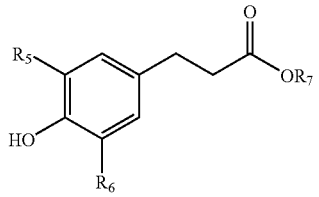

(III)

wherein $R_5$, $R_6$, and $R_7$, the same or different, represent a linear or branched $C_1$-$C_{18}$ alkyl group. By "substantially free" it is meant that the antioxidant composition or lubricant composition comprises such compounds in an amount no greater than 1 wt. %, based on the total weight of the antioxidant composition or lubricant composition, e.g., in an amount less than 0.5 weight percent, less than 0.2 weight percent, or about 0 weight percent. Preferably, the hindered phenolics of formula (III) are not readily detectable in the antioxidant compositions or lubricant compositions of the invention.

Hindered Phenolic Compounds

The antioxidant compositions of the present invention include one or more hindered phenolic compounds, which preferably comprise the reaction products formed by reacting dicyclopentadiene with one or more of phenol, p-cresol, or p-ethyl-phenol in a first step and further nuclear alkylating in a second step the condensation product with one or more olefins, such as but not limited to, tertiary olefins such as isobutylene, a tertiary hexene or a tertiary pentene, or styrene (optionally substituted styrene such as alpha-methyl styrene). The synthesis of such hindered phenolic compounds is described in detail, for example, in U.S. Pat. No. 3,305,522, previously incorporated by reference, as well as in GB 1,068,995, incorporated herein by reference.

The hindered phenolics preferably are selected from a specific class of compounds that are prepared by a two-step process, which involves reacting dicyclopentadiene with a phenolic compound selected from the group consisting of phenol, paracresol, mixed meta-para-cresol and para-ethyl phenol in the presence of a Friedel-Craft type catalyst. Preferably, the dicyclopentadiene and the phenolic compound are reacted at about a 1:1 molar ratio. More specifically, the phenolic materials that are effectively reacted with dicyclopentadiene in accordance with the first step of the synthesis process may be defined as phenolic compounds conforming to structure (IV):

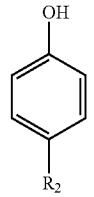

(IV)

wherein $R_2$ is defined above, but preferably is a radical selected from the group consisting of hydrogen, methyl and ethyl. Preferred proportions of reactant moieties in the resulting product are from 1.50 to 1.75 moles of phenolic compound per mole of dicyclopentadiene.

The product of the reaction between dicyclopentadiene and the phenolic compound is subsequently alkylated with at least 0.5 equivalents of an olefinic material, e.g., a tertiary olefin, per equivalent dicyclopentadiene, the olefinic material preferably being selected from the group consisting of isobutylene, tertiary hexenes, tertiary pentenes, styrene, and substituted styrenes.

The amount of olefinic material to be employed in the alkylation step will depend upon the phenolic compound used and also upon the molar ratio of phenolic compound and dicyclopentadiene in the reaction product. Thus the product prepared from phenol and dicyclopentadiene will react with more of the olefinic compound than the product from para-cresol also a reaction product of phenol containing a 2:1 molar ratio of phenol and dicyclopentadiene will react with more olefin that a 1:1 product. While products that are incompletely alkylated possess superior antioxidant properties compared to unalkylated products, preferred products are those in which alkylation is substantially complete. Preferred proportions of reactant moieties in the final alkylation product are from 1.0 to 2.0 mols of tertiary olefinic material per mol of dicyclopentadiene when para-cresol, mixtures of meta-para-cresol and para-ethyl phenol are reacted with dicyclopentadiene to produce the product of step one. The preferred proportions of reactant moieties in the final alkylation product are from 2.0 to 4.0 mols of tertiary olefinic material per mol of dicyclopentadiene when phenol is reacted with dicyclopentadiene to produce the product of step one. A slight excess of the alkylating agent preferably is employed to assure that the desired amount reacts with the product of the first step.

The reaction between dicyclopentadiene and the phenolic compounds is effectively catalyzed by a Friedel-Craft type catalyst, and in particular the more potent Friedel-Craft catalysts such as aluminum chloride, zinc chloride, ferrous and ferric chloride and boron trifluoride, as well as complexes based on boron trifluoride. Boron trifluoride and complexes based on boron trifluoride are preferred catalysts for the first step. The second step of the above described two-step reaction process, wherein the product obtained by reacting dicyclopentadiene and a phenolic compound is further alkylated with an olefin, e.g., a tertiary olefin, styrene or substituted styrene, is effectively catalyzed by employing one or more of the customary acidic alkylation catalysts such as sulfuric acid, benzene sulfonic acid, toluene sulfonic acid, acid activated clays, boron trifluoride, zinc chloride, ferrous and ferric halides, aluminum halides and the stannous and stannic halides. Sulfuric acid, benzene sulfonic acid, toluene sulfonic acid and acid activated clay are preferred catalysts for the second step of the disclosed process. Other preferred catalysts for the second step include boron trifluoride, methanesulfonic acid, and p-toluene-sulfonic acid. The catalysts employed in both the first and second stages of the disclosed process are employed in the customary catalytic amounts, which will normally vary from 0.1 percent to 5.0 percent of catalyst based on the total weight of the reactants in the reaction which is to be catalyzed.

The reaction defined as step one of the disclosed two step process, wherein dicyclopentadiene is reacted with a phenolic compound, preferably is conducted at a temperature from 25 to 1600° C., e.g., from 80 and 1500° C. The reaction between dicyclopentadiene and the phenolic compound may be started at room temperature and since the reaction is quite rapid and exothermic, the heat of reaction may be used to obtain the final reaction temperature. If adequate cooling facilities are available, the reaction may be carried out on a continuous basis.

The molar ratio of phenolic compound to dicyclopentadiene employed in the reaction mixture of stage one of the disclosed process can be varied from 1:1 to 5:1 or more, e.g., from 1:1 to 2:1 or from 2:1 to 4:1, with a preferred ratio being about 3:1. The above preferred proportions of reactants provide for a substantial excess of the phenolic compounds beyond that which will actually react with the dicyclopentadiene. The preferred molar ratio of reactant moieties in the product obtained from step one of the disclosed process may range from 1.50 to 1.75 mols of phenolic compound per mol of dicyclopentadiene. In some instances it may be desirable to carry out stage one of the disclosed process in an inert organic solvent such as benzene, toluene, etc. The employment of a solvent is particularly desirable if a relatively low ratio of phenolic compound to dicyclopentadiene is used. When the molar ratio of phenolic compound to dicyclopentadiene is 3:1 or greater, the excess phenolic compound acts as an effective solvent and no additional solvent need be employed.

Step one of the process may be carried out, for example, by adding the dicyclopentadiene to the mixture of phenolic compound and catalyst or the catalyst may be added gradually to the mixture of phenolic compound and dicyclopentadiene. The rate at which the reactants are combined can vary over a wide range as long as the temperature is kept below 1600° C.

The second step of the synthesis process involves alkylation of the product obtained in step one. In carrying out the second step of the process the resinous product obtained from step one preferably is dissolved in an equal quantity of an inert hydrocarbon solvent such as benzene, toluene, etc. Alkylation optionally is conducted at a temperature from 20 and 100° C., e.g., from 60 and 80° C. If the tertiary olefin that is employed as an alkylation agent is a gas, it may be added to the reaction mixture under pressure, but the pressures should not exceed 30 p.s.i. (207 kPa) if excessive polymerization is to be avoided. In step two of the process, it is also preferable to carry out the alkylation as rapidly as possible, however the time within which the reaction is completed depends upon the activity of the alkylating agent used.

The chemical composition of the complex reaction mixture comprising rather high molecular weight phenolic molecules obtained in the above-described synthesis process is incapable of being assigned a precise chemical formula. Generally, however, the hindered phenolic compound employed in the antioxidant compositions of the invention include those having the general formula (I):

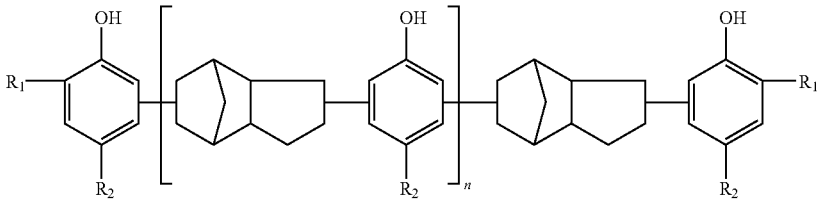

(I)

wherein n is 0-50, and $R_1$ and $R_2$ are independently hydrogen, a straight or branched $C_1$-$C_{30}$ alkyl or alkylene group optionally substituted with one or more substituents, $C_3$-$C_{12}$ cycloalkyl, $C_5$-$C_{12}$ aryl, or $C_6$-$C_{12}$ alkylaryl. In a particularly preferred embodiment, $R_1$ is t-butyl, and $R_2$ is methyl. $R_2$ preferably is an alkyl or alkylene group having five or fewer carbons. For example, $R_2$ may be selected from the group consisting of methyl, ethyl, propyl, isopropyl, n-butyl, isobutyl, sec-butyl, t-butyl, pentyl and neopentyl.

More preferably, the antioxidant composition comprises a hindered phenolic compound having the general formula (V):

(V)

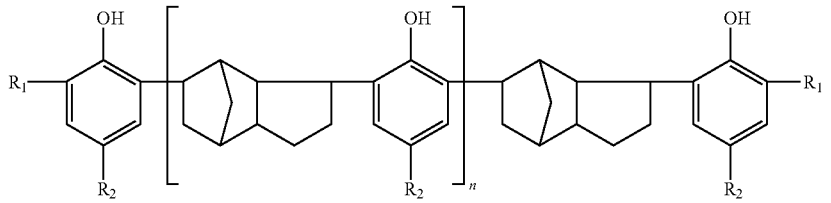

wherein $R_1$, $R_2$ and n are as defined above. In a particularly preferred embodiment, $R_1$ is t-butyl, and $R_2$ is methyl. In another embodiment, $R_1$ is tert-butyl or styrenyl optionally substituted (e.g., methyl or ethyl substituted) on the α-position.

A specific example of a commercially available sterically hindered phenol that may be employed in the antioxidant composition for the purposes of the present invention is Lowinox™ CPL of Great Lakes Chemical Corporation, also known as Wnigstay™ L of Goodyear, which is the reaction product of p-cresol with dicyclopentadiene, followed by isobutylene alkylation and having a molecular weight [g/mol] of 600-700.

As indicated above, certain hindered phenolics preferably are avoided in the antioxidant compositions of the invention. In particular, some phenolics may decompose at elevated temperatures and hence may be unsuitable for certain end use applications, e.g., motor oil applications. The antioxidant compositions or lubricant compositions of the invention preferably are substantially free of hindered phenolics of formula (III):

(III)

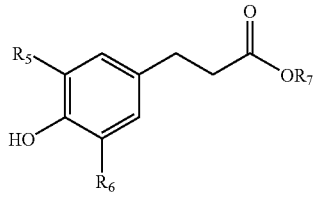

wherein $R_5$, $R_6$, and $R_7$, the same or different, represent a linear or branched $C_1$-$C_{18}$ alkyl group. In one aspect, for example, $R_5$ and $R_6$ are t-butyl and $R_7$ represents a linear or branched $C_8$-$C_{18}$ alkyl group. In this context, by "substantially free" it is meant that the antioxidant composition or lubricant composition comprises such compounds in an amount no greater than 1 wt. %, based on the total weight of the antioxidant composition or lubricant composition, e.g., in an amount less than 0.5 weight percent, less than 0.2 weight percent, or about 0 weight percent. Preferably, the hindered phenolics of formula (III) are not readily detectable in the antioxidant compositions or lubricant compositions of the invention. Of course, in other embodiments, the antioxidant composition may comprise such hindered phenolics of formula (III), although preferably in minor amounts.

Diarylamines

As indicated above, the antioxidant compositions of the present invention also comprise one or more diarylamines, preferably of formula (II).

$$(R_3)_a—Ar_1—NH—Ar_2—(R_4)_b \quad (II)$$

wherein $Ar_1$ and $Ar_2$ are independently aromatic hydrocarbon groups and $R_3$ and $R_4$ are independently hydrogen or hydrocarbyl groups having from 6 to about 100 carbon atoms and a and b are independently 0 to 3 but (a+b) is not greater than 4.

Commercially available diarylamines that may be employed in the antioxidant compositions of the invention include, for example, Naugalube 438L by Chemtura Corporation™ (mixture of mono- and di-nonyl diphenyl amine). Additional exemplary diarylamines include diphenylamine; N-allyldiphenylamine; 4-isopropoxy-diphenylamine; N-phenyl-1-naphthylamine; N-(4-t-octyl-phenyl) 1-naphthylamine; N-phenyl-2-naphtbylamine; and diphenylamine octylate such as, for example, p,p'-di-t-octyldiphenylamine.

Additional examples of secondary diarylamine compounds that are useful in the practice of the present invention include, but are not limited to, diphenylamine, monalkylated diphenylamine, dialkylated diphenylamine, trialkylated diphenylamine, or mixtures thereof, 3-hydroxydiphenylamine, 4-hydroxydiphenylamine, mono- and/or di-butyldiphenylamine, mono- and/or di-octyldiphenylamine, mono- and/or di-nonyldiphenylamine, phenyl-α-naphthylamine, phenyl-β-naphthylamine, diheptyldiphenylamine, mono- and/or di-(α-methylstyryl) diphenylamine, mono- and/or distyryidiphenylamine, 4-(p-toluenesulfonamido)diphenylamine, 4-isopropoxydiphenylamine, t-octylated N-phenyl-1-naphthylamine, mixtures of mono- and dialkylated t-butyl-t-octyldiphenylamines, N-phenyl-1,2-phenylenediamine, N-phenyl-1,4-phenylenediamine, N,N'-diphenyl-p-phenylenediamine, N,N'-di(naphthyl-2-)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, and N-cyclohexyl-N'-phenyl-p-phenylenediamine. The following are exemplary of the secondary diarylamine compounds just defined and are commercially available from Chemtura Corporation: Naugalube™ 438, Naugalube 438L, Naugalube 640 (octylated, butylated diphenyl amine), Naugalube 635, Naugalube 680, Naugalube AMS, Naugalube APAN, Naugard PANA, Naugalube 403, Naugalube 410, and Naugalube 420; from Ciba-Geigy: Irganox™ L 06 and Irganox L 57; from R. T. Vanderbilt: Vanlube SL, Vanlube 961, Vanlube 81, Vanlube SS, Vanlube DND; from Albermarle: Ethanox 4720, Ethanox 4793, Ethanox 4780; from Rhein Chemie: Additin M-10314; and from Lubrizol: Good-rite 3128.

Antioxidant Compositions

It has now been found that antioxidant compositions comprising, consisting essentially of, or consisting of: (a) a first antioxidant comprising a solid compound belonging to the group of sterically hindered phenols of formula (I), above, and (b) a second antioxidant comprising a liquid diarylamine compound of formula (II), above, have surprisingly desirable stabilizing properties. Additionally, the antioxidant compositions of the invention preferably are capable of permanently remaining liquid, both at room temperature and at temperatures lower than 0° C. (for example, as low as −30° C.) thereby imparting desirable handling characteristics for a wide range of temperatures.

The relative amounts of the first and second antioxidants that are contained in the antioxidant compositions of the invention may vary widely. In some preferred embodiments, for example, the antioxidant composition comprises the first antioxidant of formula (I) in an amount greater than 1 weight percent, e.g., greater than 5 weight percent or greater than 10 weight percent, based on the total weight of all antioxidants contained in the antioxidant composition. In terms of ranges, the antioxidant composition optionally comprises the first antioxidant of formula (I) in an amount ranging from 5 to 50 weight percent, e.g., from 5 to 40 weight percent or from 10 to 30 weight percent, based on the total weight of all antioxidants contained in the antioxidant composition.

The antioxidant composition also preferably comprises the second antioxidant of formula (II) in an amount greater than 1 weight percent, e.g., greater than 50 weight percent, greater than 60 weight percent or greater than 70 weight percent, based on the total weight of all antioxidants contained in the antioxidant composition. In terms of ranges, the antioxidant composition optionally comprises the second antioxidant of formula (II) in an amount ranging from 50 to 95 weight percent, e.g., from 60 to 95 weight percent or from 70 to 90 weight percent, based on the total weight of all antioxidants contained in the antioxidant composition.

The weight ratios of the second antioxidant of formula (II) to the first antioxidant of formula (I) contained in the antioxidant compositions of the invention similarly may vary widely. In some preferred embodiments, the antioxidant compositions of the invention comprise the second antioxidant of formula (II) and the first antioxidant of formula (I) in a weight ratio greater than 3:1, e.g., greater than 4:1, or greater than 5:1. Preferably the weight ratio of the second antioxidant to the first antioxidant is no greater than 19:1. In terms of ranges, the weight ratio of the second antioxidant to the first antioxidant optionally is from 1:99 to 99:1, e.g., from 3:1 to 19:1 or from 5:1 to 19:1.

In addition to the above-described hindered phenolic compounds of formula (I) and diarylamine compounds of formula (II), the antioxidant compositions of the present invention may include one or more additional antioxidants, although preferably none of the additional antioxidants are of formula (III), above.

The antioxidant compositions can be prepared by means of various processes. Preferably, however, either or both the hindered phenolic composition of formula (I) and/or the diarylamine compound of formula (II) are heated prior to being combined with one another.

For example, in one embodiment, the antioxidant compositions of the invention are prepared by a process comprising the steps of: (a) heating either or both the first antioxidant (e.g., the hindered phenolic compound of formula (I)) and/or the second antioxidant (e.g., the diarylamine of formula (II)) to a temperature ranging from 60° C. to 180° C., more preferably from 70° C. to 140° C., from 90° C. to 120° C., or about 100° C., preferably under stirring; and (b) combining the first and second antioxidants to form the antioxidant composition. During the combining step, either antioxidant may be added to the other antioxidant. Preferably, the resulting mixture is continuously stirred until complete dissolution of the first antioxidant, for a time ranging, for example, from 5 minutes to 100 minutes, preferably from 10 minutes to 60 minutes. The resulting antioxidant composition is a liquid at room temperature. Ideally, the antioxidant composition has a kinematic viscosity at 100° C. of less than 80 cSt, e.g., less than 60 cSt or less than 40 cSt.

The liquid mixture thus obtained may be discharged into drums or tanks and remains permanently liquid, without reprecipitation of the solid compound (the hindered phenolic compound of formula (I)), at room temperature.

Stabilization of Lubricants

The antioxidant compositions of the invention may be employed in stabilizing lubricant compositions, e.g., lubricant base stock compositions. Suitable base stocks may be selected from the group consisting of those used in engine oils, transmission fluids, hydraulic fluids, gear oils, marine cylinder oils, compressor oils, refrigeration lubricants, aviation turbine oils, gas turbine oils, chain oils, metal working fluids, and mixtures thereof.

The antioxidant compositions of the present invention preferably improve the oxidative stability of lubricants, which are subject to oxidative, thermal, and/or light-induced degradation. These lubricants may be natural or synthetic and may include, for example, "functional fluids," lubricating oils, greases, and fuels, as well as automatic and manual transmission fluids, power steering fluid, hydraulic fluids, gas turbine oils, compressor lubricants, automotive and industrial gear lubricants, and heat transfer oils. Lubricating oil compositions useful in the practice of the present invention preferably comprise a major amount of oil of lubricating viscosity and a minor amount of at least one antioxidant composition of the present invention.

Oils of lubricating viscosity useful in the context of the present invention can be selected from natural lubricating oils, synthetic lubricating oils, and mixtures thereof. The lubricating oil can range in viscosity from light distillate mineral oils to heavy lubricating oils, such as gasoline engine oils, mineral lubricating oils, and heavy duty diesel oils. Generally, the viscosity of the oil ranges from about 2 centistokes to about 40 centistokes, especially from about 4 centistokes to about 20 centistokes, as measured at 100° C.

Diesel fuel oils are petroleum-based fuel oils, especially middle distillate fuel oils. Such distillate fuel oils generally boil within the range of from 110° C. to 500° C., e.g., from 150° C. to 400° C. The fuel oil may comprise atmospheric distillate or vacuum distillate, cracked gas oil, or a blend in any proportion of straight run and thermally and/or refinery streams such as catalytically cracked and hydro-cracked distillates.

Suitable diesel fuels include, for example, Fischer-Tropsch fuels. Fischer-Tropsch fuels, also known as FT fuels, include those described as gas-to-liquid (GTL) fuels, biomass-to-liquid (BTL) fuels and coal conversion fuels. To make such fuels, syngas ($CO+H_2$) is first generated and then converted to normal paraffins by a Fischer-Tropsch process. The normal paraffins can then be modified by processes such as catalytic cracking/reforming or isomerization, hydrocracking and hydroisomerization to yield a variety of hydrocarbons such as iso-paraffins, cyclo-paraffins and aromatic compounds. The resulting FT fuel can be used as such or in combination with other fuel components and fuel types. Also suitable are diesel fuels derived from plant or animal sources. These can be used alone or in combination with other types of fuel.

Preferably, the diesel fuel has a sulfur content of at most 0.05% by weight, more preferably of at most 0.035% by weight, especially of at most 0.015%. Fuels with even lower levels of sulfur are also suitable, such as fuels with less than 50 ppm sulfur by weight, preferably less than 20 ppm, for example, 10 ppm or less.

Oils and fats derived from plant or animal materials are increasingly finding application as fuels and, in particular, as partial or complete replacements for petroleum derived middle distillate fuels such as diesel. Commonly, such fuels are known as "biofuels" or "biodiesels." Biofuels may be derived from many sources. Among the most common are the alkyl, often methyl, esters of fatty acids extracted from plants, such as rapeseed, sunflower, and the like. These types of fuel are often referred to as FAME (fatty acid methyl esters).

Natural oils include animal oils and vegetable oils (e.g., lard oil, castor oil); liquid petroleum oils and hydrorefined, solvent-treated or acid-treated mineral oils of the paraffinic, naphthenic, and mixed paraffinic-naphthenic types. Oils of lubricating viscosity derived from coal or shale also serve as useful base oils. Other examples of oils and fats derived from animal or vegetable material are rapeseed oil, coriander oil, soya bean oil, cottonseed oil, sunflower oil, castor oil, olive oil, peanut oil, maize oil, almond oil, palm kernel oil, coconut oil, mustard seed oil, jatropha oil, beef tallow, and fish oils. Further examples include oils derived from corn, jute, sesame, shea nut, ground nut, and linseed oil, and may be derived therefrom by methods known in the art. Rapeseed oil, which is a mixture of fatty acids partially esterified with glycerol, is available in large quantities and can be obtained in a simple way by pressing from rapeseed. Recycled oils such as used kitchen oils are also suitable.

Useful examples of alkyl esters of fatty acids can include commercial mixtures of the ethyl, propyl, butyl and especially methyl esters of fatty acids with 12 to 22 carbon atoms. For example, lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid, or erucic acid are useful and have an iodine number from 50 to 150, especially 90 to 125. Mixtures with particularly advantageous properties are those which contain mainly, i.e., at least 50 wt. %, methyl esters of fatty acids with 16 to 22 carbon atoms and 1, 2, or 3 double bonds. The preferred lower alkyl esters of fatty acids are the methyl esters of oleic acid, linoleic acid, linolenic acid, and erucic acid.

Commercial mixtures of the stated kind are obtained for example by cleavage and esterification of animal and vegetable fats and oils by their transesterification with lower aliphatic alcohols. For production of alkyl esters of fatty acids, it is advantageous to start from fats and oils which contain low levels of saturated acids, less than 20%, and which have an iodine number of less than 130. Blends of the following esters or oils are suitable, e.g., rapeseed, sunflower, coriander, castor, soya bean, peanut, cotton seed, beef tallow, and the like. Alkyl esters of fatty acids based on a new variety of rapeseed oil, the fatty acid component of which comprises more than 80 wt. % unsaturated fatty acids with 18 carbon atoms, are preferred.

Particularly preferred are oils capable of being utilized as biofuels. Biofuels are believed to be less damaging to the environment on combustion and are obtained from a renewable source. It has been reported that on combustion less carbon dioxide is formed by the equivalent quantity of petroleum distillate fuel, e.g., diesel fuel, and very little sulfur dioxide is formed. Certain derivatives of vegetable oil, e.g., those obtained by saponification and re-esterification with a monohydric alkyl alcohol, can be used as a substitute for diesel fuel.

Preferred biofuels are vegetable oil derivatives, of which particularly preferred biofuels are alkyl ester derivatives of rapeseed oil, cottonseed oil, soya bean oil, sunflower oil, olive oil, or palm oil, rapeseed oil methyl ester being especially preferred, either alone or in admixture with other vegetable oil derivatives, e.g., mixtures in any proportion of rapeseed oil methyl ester and palm oil methyl ester.

At present, biofuels are most commonly used in combination with petroleum-derived oils. The present invention is applicable to mixtures of biofuel and petroleum-derived fuels in any ratio. For example, at least 5%, preferably at least 25%, more preferably at least 50%, and most preferably at least 95% by weight of the oil, may be derived from a plant or animal source.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs, and homologs thereof. Also useful are synthetic oils derived from a gas to liquid process from Fischer-Tropsch synthesized hydrocarbons, which are commonly referred to as gas to liquid or "GTL" base oils.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide and the alkyl and aryl ethers of polyoxyalkylene polymers (e.g., methylpolyisopropylene glycol ether having a molecular weight of 1000 or diphenyl ether of polyethylene glycol having a molecular weight of 1000 to 1500), and mono- and polycarboxylic esters thereof, for example, the acetic acid esters, mixed $C_3$-$C_8$ fatty acid esters, and $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2 ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

The oil of lubricating viscosity can comprise a Group I, Group II, or Group III base stock or base oil blends of the aforementioned base stocks. Preferably, the oil of lubricating viscosity is a Group II or Group III base stock, or a mixture thereof, or a mixture of a Group I base stock and one or more of a Group II and Group III. Preferably, a major amount of the oil of lubricating viscosity is a Group II, Group III, Group IV, or Group V base stock, or a mixture thereof. The base stock, or base stock blend, preferably has a saturate content of at least 65%, more preferably at least 75%, such as at least 85%. Most preferably, the base stock, or base stock blend, has a saturate content of greater than 90%. Preferably, the oil or oil blend will have a sulfur content of less than 1%, preferably less than 0.6%, and most preferably less than 0.4%, by weight.

Preferably, the volatility of the oil or oil blend, as measured by the Noack volatility test (ASTM D5880), is less than or equal to 30%, preferably less than or equal to 25%, more preferably less than or equal to 20%, most preferably less than or equal to 16%. Preferably, the viscosity index (VI) of the oil or oil blend is at least 85, preferably at least 100, most preferably from about 105 to 140.

Definitions for the base stocks and base oils in this invention are the same as those found in the American Petroleum Institute (API) publication "Engine Oil Licensing and Certification System," Industry Services Department (14th ed., Dec. 1996), Addendum 1, Dec. 1998. This publication categorizes base stocks as follows.

(a) Group I base stocks contain less than 90 percent saturates and/or greater than 0.03 percent sulfur and have a viscosity index greater than or equal to 80 and less than 120 using the test methods specified in Table 1.

(b) Group II base stocks contain greater than or equal to 90 percent saturates and less than or equal to 0.03 percent sulfur and have a viscosity index greater than or equal to 80 and less than 120 using the test methods specified in Table 1.

(c) Group III base stocks contain greater than or equal to 90 percent saturates and less than or equal to 0.03 percent sulfur and have a viscosity index greater than or equal to 120 using the test methods specified in Table 1, the entireties of which are incorporated herein by reference.

(d) Group IV base stocks are polyalphaolefins (PAO).

(e) Group V base stocks include all other base stocks not included in Groups I, II, III, or IV.

TABLE 1

| Analytical Methods for Base Stock Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

Thus, a further embodiment of the present invention relates to lubricant compositions containing a lubricant (e.g., base stock) of lubricating viscosity and an effective quantity of an antioxidant composition of the present invention. The antioxidant composition may be added to the lubricant to be stabilized in a quantity ranging, for example, from 0.01 wt. % to 3.0 wt. % with respect to the weight of the lubricant to be stabilized (including the base stock, the antioxidant composition of the invention and additives, if any), preferably from 0.01 wt. % to 2.5 wt. %, from 0.03 wt. % to 2 wt. %, from 0.1 wt. % to 1 wt. %, from 0.1 wt. % to 3.0 wt. % or from 1.0 wt. % to 1.5 wt. %. For example, The lubricant composition optionally comprises a base stock in an amount from 65 to 99.9 wt. %, and the antioxidant composition in an amount from 0.05 to 3 wt. %, based on the total weight of the lubricant composition.

As indicated above, the antioxidant compositions of the invention provide the ability to stabilize lubricants at low ZDDP levels. In some embodiments, the lubricant composition comprises ZDDP in an amount no greater than 1 wt. %, e.g., in an amount less than 0.7 wt. %, e.g., less than 0.5 wt. % or less than 0.3 wt. %, based on the total weight of the lubricant composition (including antioxidant composition, base stock and any additives).

In addition, since the antioxidant compositions preferably are substantially free of antioxidants of formula (III), the lubricant compositions of the invention preferably remain stable at high temperature oxidation conditions. Antioxidant stability at elevated temperatures may be determined measuring the oxidation induction time (OIT) of a sample during Pressurized Differential Scanning Calorimeter (PDSC) Testing, described below in Example 3. In some embodiments, for example, the lubricant compositions of the invention have a PDSC OIT value greater than 40 minutes, e.g., greater than 50 minutes or greater than 60 minutes.

Although the antioxidant compositions of the invention are particularly well-suited for lubricant applications, it is also contemplated that the antioxidant compositions may be employed as stabilizers or antioxidants in polymer applications. See, for example, Published Application No. US2003/0144395 A1, the entirety of which is incorporated herein by reference. A further embodiment of the present invention therefore relates to polymeric compositions containing an organic polymer and an effective quantity of one of the antioxidant compositions of the present invention. The antioxidant compositions may be added to the organic polymers to be stabilized in a quantity ranging, for example, from 0.01% to 3.0% with respect to the weight of the organic polymer to be stabilized, preferably from 0.01 wt. % to 2.5 wt. %, from 0.03 wt. % to 2 wt. %, from 0.1 wt. % to 1 wt. %, from 0.1 wt. % to 3.0 wt. % or from 1.0 wt. % to 1.5 wt. %. Yet another embodiment relates to the end-products obtained from the processing of the above polymeric compositions.

Additional Additives

Additional additives may be incorporated in the antioxidant and/or lubricant compositions of the invention to enable them to meet particular requirements. Examples of additives that may be included in the antioxidant compositions and lubricating oil compositions are dispersants, detergents, metal rust inhibitors, viscosity index improvers, corrosion inhibitors, (additional) oxidation inhibitors, friction modifiers, other dispersants, anti-foaming agents, anti-wear agents and pour point depressants. Thus, in some embodiments, the invention is to an antioxidant and/or a lubricant composition, as described above, but further comprising at least one lubricating oil additive selected from the group consisting of antioxidants, anti-wear agents, detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and mixtures thereof. Some of these additives are discussed in further detail below.

Lubricating oil compositions of the present invention can further contain one or more ashless dispersants, which effectively reduce formation of deposits upon use in gasoline and diesel engines, when added to lubricating oils. Ashless dispersants useful in the compositions of the present invention include, for example, an oil soluble polymeric long chain backbone having functional groups capable of associating with particles to be dispersed. Typically, such dispersants comprise amine, alcohol, amide or ester polar moieties attached to the polymer backbone, often via a bridging group. The ashless dispersant can be, for example, selected from oil soluble salts, esters, amino-esters, amides, imides, and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

Preferred dispersants include polyamine-derivatized poly alpha-olefin, dispersants, particularly ethylene/butene alpha-olefin and polyisobutylene-based dispersants. Particularly preferred are ashless dispersants derived from polyisobutylene substituted with succinic anhydride groups and reacted with polyethylene amines, e.g., polyisobutylene succinimide, polyethylene diamine, tetraethylene pentamine; or a polyoxyalkylene polyamine, e.g., polyoxypropylene diamine, trimethylolaminomethane; a hydroxy compound, e.g., pentaerythritol; and combinations thereof. One particularly preferred dispersant combination is a combination of (A) polyisobutylene substituted with succinic anhydride groups and reacted with (B) a hydroxy compound, e.g., pentaerythritol; (C) a polyoxyalkylene polyamine, e.g., polyoxypropylene diamine, or (D) a polyalkylene diamine, e.g., polyethylene diamine and tetraethylene pentamine using about 0.3 to about 2 moles of (B), (C) and/or (D) per mole of (A). Another preferred dispersant combination comprises a combination of (A) polyisobutenyl succinic anhydride with (B) a polyalkylene polyamine, e.g., tetraethylene pentamine, and (C) a polyhydric alcohol or polyhydroxy-substituted aliphatic primary amine, e.g., pentaerythritol or trismethylolaminomethane, as described in U.S. Pat. No. 3,632,511.

For adequate piston deposit control, a nitrogen-containing dispersant can be added in an amount providing the lubricating oil composition with from about 0.03 wt. % to about 0.15 wt. %, preferably from about 0.07 to about 0.12 wt. %, of nitrogen.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts can contain a substantially stoichiometric amount of the metal, in which case they are usually described as normal or neutral salts, and would typically have a total base number or TBN (as can be measured by ASTM D2896) of from 0 to 80. A large amount of a metal base can be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents can have a TBN of 150 or greater and typically will have a TBN of from 250 to 450 or more.

Detergents that can be used include oil-soluble neutral and overbased sulfonates, phenates, sulfurized phenates, thiophosphonates, salicylates, naphthenates, and other oil-soluble carboxylates of a metal, particularly the alkali or alkaline earth metals, e.g., sodium, potassium, lithium, calcium, and magnesium. The most commonly used metals are calcium and magnesium, which can both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450. Combinations of detergents, whether overbased or neutral or both, can be used.

Sulfonates can be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl, or their halogen derivatives such as chlorobenzene, chlorotoluene and chloronaphthalene. The alkylation can be performed in the presence of a catalyst with alkylating agents having from about 3 to more than 70 carbon atoms. The alkaryl sulfonates usually contain from about 9 to about 80 or more carbon atoms, preferably from about 16 to about 60 carbon atoms, per alkyl substituted aromatic moiety.

The oil soluble sulfonates or alkaryl sulfonic acids can be neutralized with oxides, hydroxides, alkoxides, carbonates, carboxylate, sulfides, hydrosulfides, nitrates, borates, and ethers of the metal. The amount of metal compound is chosen having regard to the desired TBN of the final product but typically ranges from about 100 to 220 wt. % (preferably at least 125 wt. %) of that stoichiometrically required.

Metal salts of phenols and sulfurized phenols are prepared by reaction with an appropriate metal compound such as an oxide or hydroxide, and neutral or overbased products can be obtained by methods well known in the art. Sulfurized phenols can be prepared by reacting a phenol with sulfur or a sulfur containing compound such as hydrogen sulfide, sulfur monohalide, or sulfur dihalide, to form products which are generally mixtures of compounds in which two or more phenols are bridged by sulfur containing bridges.

Dihydrocarbyl dithiophosphate metal salts are frequently used as antiwear and antioxidant agents. The metal can be an alkali or alkaline earth metal, or aluminum, lead, tin, molybdenum, manganese, nickel or copper. The zinc salts are most commonly used in lubricating oil in amounts of 0.1 to 10 wt. %, preferably 0.2 to 2 wt. %, based upon the total weight of the lubricating oil composition. They can be prepared in accordance with known techniques by first forming a dihydrocarbyl dithiophosphoric acid (DDPA), usually by reaction of one or more alcohols or a phenol with $P_2S_5$ and then neutralizing the formed DDPA with a zinc compound. For example, a dithiophosphoric acid can be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used, but the oxides, hydroxides, and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and can comprise zinc dialkyl dithiophosphates. The present invention can be particularly useful when used with passenger car diesel engine lubricant compositions containing phosphorus levels of from about 0.02 to about 0.12 wt. %, such as from about 0.03 to about 0.10 wt. %, or from about 0.05 to about 0.08 wt. %, based on the total mass of the composition and heavy duty diesel engine lubricant compositions containing phosphorus levels of from about 0.02 to about 0.16 wt. %, such as from about 0.05 to about 0.14 wt. %, or from about 0.08 to about 0.12 wt. %, based on the total mass of the composition. In one preferred embodiment, lubricating oil compositions of the present invention contain zinc dialkyl dithiophosphate derived predominantly (e.g., over 50 mol. %, such as over 60 mol. %) from secondary alcohols. The following are exemplary of such antiwear additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others; and from Ciba-Geigy: Irgalube 353.

Oxidation inhibitors or antioxidants reduce the tendency of lubricant compositions to deteriorate in service. Oxidative deterioration can be evidenced by sludge in the lubricant, varnish-like deposits on the metal surfaces, and by viscosity growth. Such oxidation inhibitors may include (in addition to the first and second oxidants employed in the antioxidant compositions of the present invention) hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons, phosphorous esters, metal thiocarbamates, oil soluble copper compounds as described in U.S. Pat. No. 4,867,890, molybdenum-containing compounds and aromatic amines (in addition to the aromatic amines of formula (II), above).

One or more additional antioxidants may be employed with the first and second antioxidants in the antioxidant compositions and lubricant compositions of the invention. In one preferred embodiment, the lubricating oil composition of the present invention contains from about 0.1 to about 1.2 wt. % of aminic antioxidant (including the second antioxidant of formula (II)) and from about 0.1 to about 3 wt. % of phenolic antioxidant (including the first antioxidant of formula (I)). In another preferred embodiment, lubricating oil compositions of the present invention contain from about 0.1 to about 1.2 wt. % of aminic antioxidant, from about 0.1 to about 3 wt. % of phenolic antioxidant and a molybdenum compound in an amount providing the lubricating oil composition from about 10 to about 1000 ppm of molybdenum. Preferably, lubricating oil compositions useful in the practice of the present invention, particularly lubricating oil compositions useful in the practice of the present invention that are required to contain no greater than 1200 ppm of phosphorus, contain ashless antioxidants in an amount of from about 0.1 to about 5 wt. %, preferably from about 0.3 wt. % to about 4 wt. %, more preferably from about 0.5 wt. % to about 3 wt. %. Where the phosphorus content is required to be lower, the amount of ashless antioxidant other than the first and second antioxidants will preferably increase accordingly.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrenelbutadiene, and isoprene/butadiene, as well as the partially hydrogenated homopolymers of butadiene and isoprene.

A viscosity index improver dispersant functions both as a viscosity index improver and as a dispersant. Examples of viscosity index improver dispersants include reaction products of amines, for example, polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant can be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ dicarboxylic acid with an unsaturated nitrogen-containing monomer having 4 to 20 carbon atoms; a polymer of a $C_2$ to $C_{20}$ olefin with an unsaturated $C_3$ to $C_{10}$ mono- or dicarboxylic acid neutralized with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine, or alcohol.

Friction modifiers and fuel economy agents that are compatible with the other ingredients of the final oil can also be included. Examples of such materials include glyceryl monoesters of higher fatty acids, for example, glyceryl monooleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Examples of such oil soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates, and alkylthioxanthates.

Additionally, the molybdenum compound can be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula: $Mo(ROCS_2)_4$ and $Mo(RSCS_2)_4$, wherein R is an organo group selected from the group consisting of alkyl, aryl, aralkyl, and alkoxyalkyl, generally of from 1 to 30 carbon atoms, preferably 2 to 12 carbon atoms, and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $MO_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligand organo groups, such as at least 25, at least 30, or at least 35 carbon atoms.

The following are exemplary of molybdenum friction modifier additives and are commercially available from R. T. Vanderbilt Company, Inc.: Molyvan™ A, Molyvan L, Molyvan 807, Molyvan 856B, Molyvan 822, Molyvan 855, among others. The following are also exemplary of such additives and are commercially available from Asahi Denka Kogyo K. K.: SAKURA-LUBE™ 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, among others. The following are also exemplary of such friction modifier additives and are commercially available from Akzo Nobel Chemicals GmbH: Ketjen-Ox™ 77M, Ketjen-Ox 77TS, among others. Naugalube MolyFM is also exemplary of such additives and is commercially available from Chemtura Corporation.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane. An example of a pour point depressant is polymethacrylate, and the like.

Some of the above-mentioned additives can provide a multiplicity of effects; thus, for example, a single additive can act as a dispersant-oxidation inhibitor. This approach is well known and need not be further elaborated herein.

Examples of corrosion inhibitors include amine complexes, benzotriazole-, tolyltriazole-, thidiazole-, and imidazole-based compounds, and the like. The following is an exemplary corrosion inhibitors and is commercially available from King Industries, Inc.: K-Corr™ 100A2.

Examples of viscosity index (V.I.) improvers include olefin copolymers, dispersant olefin copolymers, ethylene-α-olefin copolymers wherein the α-olefin may be propylene, 1-butene, or 1-pentene, or the hydrides thereof, polyisobutylenes or the hydrides thereof, styrene-diene hydrogenated copolymers, styrene-maleate anhydride copolymers, and polyalkylstyrenes, and the like.

Example of anti-foamants include polysiloxane, silicones such as dimethylsilicone and fluorosilicone, and the like. The following is an exemplary anti-foamant and is commercially available from Munzing/Ultra Additives: Foam Ban™ MS-575.

In the present invention it may be necessary to include an additive that maintains the stability of the viscosity of the blend. Thus, although polar group-containing additives achieve a suitably low viscosity in the pre-blending stage, it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When lubricating compositions contain one or more of the above-mentioned additives, each additive is typically blended into the base oil in an amount that enables the additive to provide its desired function. Representative effect amounts of such additives, when used in crankcase lubricants, are listed below in Table 2. All the values listed are stated as weight percent active ingredient.

TABLE 2

| ADDITIVE | Wt % (Desirable) | Wt % (Preferred) |
|---|---|---|
| Overbased Detergents | 0.1-15 | 0.2-9 |
| Corrosion Inhibitor | 0.0-5 | 0.0-1.5 |
| Anti-wear agents | 0.1-6 | 0.1-4 |
| Dispersants | 0.1-10 | 0.1-5 |
| Antioxidant* | 0.01-5 | 0.01-3 |
| Pour Point Depressant | 0.0-5 | 0.01-1.5 |
| Antifoaming Agent | 0.0-5 | 0.001-0.15 |
| Friction Modifier | 0.0-5 | 0.0-1.5 |
| Viscosity Index Improver | 0.01-10 | 0.25-3 |
| Base stock | Balance (i.e. ~60-99.99) | Balance (i.e. ~80 to 99.99) |

*Includes the first antioxidant of formula (I) and the second antioxidant of formula (II).

Fully formulated passenger car diesel engine lubricating oil (PCDO) compositions of the present invention preferably have a sulfur content of less than about 0.4 wt. %, such as less than about 0.35 wt. %, more preferably less than about 0.03 wt. %, such as less than about 0.15 wt. %. Preferably, the Noack volatility of the fully formulated PCDO (oil of lubricating viscosity plus all additives) will be no greater than 13, such as no greater than 12, preferably no greater than 10. Fully formulated PCDOs of the present invention preferably have no greater than 1200 ppm of phosphorus, such as no greater than 1000 ppm of phosphorus, or no greater than 800 ppm of phosphorus. Fully formulated PCDOs of the present invention preferably have a sulfated ash (SASH) content of about 1.0 wt. % or less.

Fully formulated heavy duty diesel engine (HDD) lubricating oil compositions of the present invention preferably have a sulfur content of less than about 1.0 wt. %, such as less than about 0.6 wt. %, more preferably less than about 0.4 wt. %, such as less than about 0.15 wt. %. Preferably, the Noack volatility of the fully formulated HDD lubricating oil composition (oil of lubricating viscosity plus all additives) will be no greater than 20, such as no greater than 15, preferably no greater than 12. Fully formulated HDD lubricating oil compositions of the present invention preferably have no greater than 1600 ppm of phosphorus, such as no greater than 1400 ppm of phosphorus, or no greater than 1200 ppm of phosphorus. Fully formulated HDD lubricating oil compositions of the present invention preferably have a sulfated ash (SASH) content of about 1.0 wt. % or less.

Some illustrative but non-limiting, examples of the present invention are provided for a better understanding of the present invention and for its embodiment.

EXAMPLE 1

TEOST Analysis

The antioxidant effect of antioxidant compositions comprising a polymeric hindered phenol of formula (I) and its synergistic effect with secondary diarylamines of formula (II) according to the some embodiments of the invention were demonstrated in a low phosphorus-containing SAE 5W20 fully formulated engine oil, tested using an accelerated oxidation bench test, specifically, the mid-high temperature Thermo-oxidation Engine Oil Simulation Test (TEOST, ASTM D7097, incorporated herein by reference).

The SAE 5W20 engine oil formulation was pre-blended as indicated in Table 3 with commercially available components. There is no particular restriction on the type and exact composition of the materials in the context of the present invention.

TABLE 3

SAE 5W20 Engine Oil Pre-blend Formula

| Composition | Amounts in composition, wt % |
|---|---|
| Base oil, Group II | Balance |
| Overbased Calcium Sulfonate Detergents | 2.5 |
| ZDDP | 0.5 |
| Succinimide Dispersant | 6.4 |
| Pour Point Depressant | 0.1 |
| OCP VI Improver | 5.0 |

A polymeric hindered phenol of formula (I) was added to the engine oil pre-blend, optionally in admixture of a secondary diarylamine of formula (II). The relative amounts of the hindered phenol and the secondary diarylamines are as indicated in Table 5, below. The total amount of added antioxidants was from 1.0 to 1.5 weight percent. The finished engine oils comprised approximately 0.044% of phosphorous by weight.

The polymeric hindered phenol used in the test was Lowinox®CPL, which is a reaction product of p-cresol with dicyclopentadiene and isohutylene and having a molecular weight [g/mol] of 600-700. The secondary diarylamine used in the test was a complex mixture of predominantly mono- and di-nonyl diphenylamine, currently being sold under the trade designation Naugalube 438L. Both products are commercially available from Chemtura Corporation (Middlebury, Conn., USA).

Thermo-Oxidation Engine Oil Simulation Test (TEOST, ASTM D 7097)

The mid-high temperature Thermal-oxidation Engine Oil Simulation Test (TEOST, ASTM D7097) was performed to determine the deposit forming tendencies of the engine oil. This test determines the mass of deposits formed on a specially constructed steel rod by continuously stressing a repetitive passage of 8.5 g of test oil under thermal-oxidative and catalytic conditions. The instrument used was manufactured by Tannas Co. and has a typical repeatability of 0.1 5(x+16) mg wherein x is the mean of two or more repeated test results. The TEOST test conditions are listed in Table 4. The less the amount of deposits obtained, the better the oxidation stability of the oil.

TABLE 4

TEOST MHT Test Conditions

| Test Parameters | Settings |
|---|---|
| Test duration | 24 hours |
| Rod Temperature | 285° C. |
| Sample size | 8.5 g (mixture of 8.4 g of oil and 0.1 g of catalyst) |
| Sample flow rate | 0.25 g/min |
| Flow rate (dry air) | 10 ml/min |
| Catalyst | Oil soluble mixture containing Fe, Pb, and Sn |

Table 5 shows the TEOST test results. The lower amounts of deposits obtained for the Blends 2 and 5 as compared to the Blend 1 demonstrate the strong antioxidant action of the polymeric hindered phenol of formula (I) in terms of the control of deposit formation. The lower amounts of deposits obtained for Blends 4, 7 and 8 as compared to the amounts of deposits obtained for the respective blends containing a single antioxidant demonstrates that the lubricating oil compositions containing the antioxidant mixtures according to the practice of this invention have superior oxidative stability to produce lower amounts of deposits in the TEOST.

TABLE 5

TEOST Test Results

| Blend | Antioxidant 1 | wt. % | Antioxidant 2 | wt. % | Total wt. % | Deposits, mg |
|---|---|---|---|---|---|---|
| 1 | — | — | — | — | — | 132.0 |
| 2 | Lowinox CPL | 1.0 | — | — | 1.0 | 58.4 |
| 3 | — | — | Naugalube 438L | 1.0 | 1.0 | 55.0 |
| 4 | Lowinox CPL | 0.5 | Naugalube 438L | 0.5 | 1.0 | 45.4 |
| 5 | Lowinox CPL | 1.5 | — | — | 1.5 | 52.0 |
| 6 | — | — | Naugalube 438L | 1.5 | 1.5 | 40.6 |
| 7 | Lowinox CPL | 0.075 | Naugalube 438L | 1.425 | 1.5 | 34.2 |
| 8 | Lowinox CPL | 0.225 | Naugalube 438L | 1.275 | 1.5 | 24.4 |
| Comp | Naugalube 531† | 1.0 | — | — | 1.0 | 81.9 |
| Comp | Naugalube 531 | 0.2 | Naugalube 438L | 0.8 | 1.0 | 41.6 |
| Comp | Naugalube 531 | 1.5 | — | — | 1.5 | 62.7 |
| Comp | Naugalube 531 | 0.3 | Naugalube 438L | 1.2 | 1.5 | 32.3 |

†Naugalube 531 is 3,5-di-tert-butyl-4-hydroxyhydrocinnamic acid, $C_7$-$C_9$ branched alkyl ester.

EXAMPLE 2

RPVOT Analysis

The antioxidant effect of polymeric hindered phenols of formula (I) and their synergistic effect with secondary diarylamines of formula (II) were demonstrated in an industrial turbine oil tested by the Rotating Pressure Vessel Oxidation Test method (RPVOT, ASTM D2272).

The turbine oil formulation was pre-blended with the following commercially available components. There is no particular restriction on the type and exact composition of the materials in the context of the present invention.

TABLE 6

Turbine Oil Formulation Pre-blend

| Composition | Amounts in composition, wt % |
|---|---|
| Corrosion Inhibitor | 0.05 |
| Metal Deactivator | 0.03 |

TABLE 6-continued

| Turbine Oil Formulation Pre-blend | |
|---|---|
| Composition | Amounts in composition, wt % |
| Anti-foam agent | 0.005 |
| Base oil, Group II | Balance |

To the turbine oil pre-blend was subsequently blended with a polymeric hindered phenol of formula (I) in optional admixture with a secondary diarylamine of formula (II) according to one embodiment of the invention. The total amount of added antioxidants was 0.5 weight percent.

The polymeric hindered phenol used in the test was Lowinox® CPL, which is a reaction product of p-cresol with dicyclopentadiene and isobutylene and having a molecular weight [g/mol] of 600-700. The secondary diarylamine used in the test was a complex mixture of predominantly mono- and di-nonyl diphenylamine, currently sold under the trade designation Naugalube™ 438L. Both products are commercially available from Chemtura Corporation (Middlebury, Conn.).

Rotating Pressure Vessel Oxidation Test (RPVOT, ASTM D2272)

The RPVOT was conducted according to the standard ASTM test method specified in D2272-02, incorporated herein by reference in its entirety. The test conditions are given in Table 7. This test utilizes an oxygen-pressured vessel to evaluate the oxidative stability of new and in-service turbine oils having the same or similar composition (base stock and additives) in the presence of water and a copper catalyst at 150° C. The test oil, water and copper catalyst coil contained in a covered glass container, are placed in a steel vessel equipped with a pressure gauge. The vessel is charged with oxygen to a pressure of 90 psi (621 kPa) and placed in a constant temperature oil bath set at 150° C., and rotated axially at 100 rpm at an angle of 30 degrees from horizontal. The number of minutes required to reach 25 psi (172 kPa) drop in gage pressure is the oxidation stability of the test sample.

TABLE 7

| RPVOT Test Conditions | |
|---|---|
| Copper Catalyst Coil Weight | 55.60 grams |
| Sample Size Weight | 50.00 grams |
| Distilled Water weight | 5.00 grams |
| Temperature, C. | 150° C. |
| Oxygen Initial Pressure at RT | 90 psi (621 kPa) |
| Pressure Drop to End Test | 25 psi (172 kPa) |

Table 8 shows the RPVOT oxidation induction time (OIT) for the turbine oil blends. It is clear that the turbine oil formulation of Blend 2 has superior oxidative stability over comparative Blend 1. The longer OIT's of Blends 4 and 5 also demonstrate that turbine oil compositions containing mixtures of the Lowinox CPL with secondary diarylamines of formula (II) possessed significantly better oxidative stability as compared to those containing a single antioxidant (Blends 2 and 3). In addition, Blends 4 and 5 exhibited greater stability than comparison Blends A, B and C.

TABLE 8

| RPVOT Results | | | | | | |
|---|---|---|---|---|---|---|
| Blend | Antioxidant 1 | wt. % | Antioxidant 2 | wt. % | AO ratio | OIT, min. |
| 1 | Nil | — | Nil | — | — | 24 |
| 2 | Lowinox CPL | 0.50 | Nil | — | — | 588 |
| 3 | Nil | — | Naugalube 438L | 0.50 | — | 525 |
| 4 | Lowinox CPL | 0.10 | Naugalube 438L | 0.40 | 20:80 | 653 |
| 5 | Lowinox CPL | 0.25 | Naugalube 438L | 0.25 | 50:50 | 733 |
| Comp. A | Naugalube 531 | 0.5 | — | — | — | 270 |
| Comp. B | Naugalube 531 | 0.1 | Naugalube 438L | 0.4 | 20:80 | 456 |
| Comp. C | Naugalube 531 | 0.25 | Naugalube 438L | 0.25 | 50:50 | 462 |

EXAMPLE 3

PDSC OIT Analysis

As discussed above, since the antioxidant compositions preferably are substantially free of antioxidants of formula (III), the lubricant compositions of the invention preferably remain stable at high temperature oxidation conditions. The stability of the lubricant compositions at high temperature oxidation conditions was determined by measuring the Oxidation Induction Time (OIT) during Pressurized Differential Scanning Calorimeter (PDSC) testing.

Pressurized Differential Scanning Calorimeter (PDSC) Testing

The PDSC method employs a steel cell under constant oxygen pressure throughout each run. The instrument has a typical repeatability of ±5.0 minutes with 95 percent confidence for an OIT of 200 minutes. At the beginning of a PDSC run, the PDSC steel cell is pressurized with oxygen and heated at a rate of 40° C. per minute to the isothermal temperature listed in Table 9. The induction time is measured from the time the sample reaches its isothermal temperature until the enthalpy change is observed. The longer the oxidation induction time, the better the oxidation stability of the oil, i.e., longer OITs indicate more stable compositions. For every 50 grams of test oil prepared, 40 μL of oil soluble ferric naphthenate (6 weight percent in mineral oil) was added, prior to PDSC testing, to facilitate 50 ppm of iron in oil.

TABLE 9

| Test Parameters | PDSC Test Conditions |
|---|---|
| Isothermal Temperature | 185° C. |
| $O_2$ Gas Pressure | 500 psi (3447 kPa) |
| $O_2$ Gas Flow Rate Through Cell | 100 ml/min, continuous |
| Catalyst | 50 ppm of Iron |
| Sample Holder | Open Aluminum Pan |
| Sample size | 1.0-2.0 mg |
| Induction Time | Enthalpy Change |

The antioxidant effect of the present invention was demonstrated in a low phosphorus-containing SAE 5W20 fully formulated engine oil. Such an engine oil was used in the PDSC testing discussed herein. The SAE 5W20 engine oil formulation should be pre-blended with the components shown in Table 3, above, all of which are commercially available. The antioxidant composition was subsequently added to the engine oil pre-blend. The PDSC testing was carried out at 185° C. The antioxidant compositions of the invention exhibited PDSC OIT values greater than 40 minutes and greater than 50 minutes. Table 10, below, provides the antioxidant compositions and PDSC OIT values obtained in Example 3. The OIT values obtained reflect the high degree of stability for the antioxidant compositions and lubricant compositions of the invention under high temperature oxidation conditions.

TABLE 10

PDSC Results tested at 185° C.

| Blend | AO 1 | wt. % | AO 2 | wt. % | AO 3 | Wt. % | Total, wt. % | OIT (min.) |
|---|---|---|---|---|---|---|---|---|
| blank | nil | — | nil | — | nil | — | — | <0.5 |
| 1 | Lowinox CPL | 0.15 | Naugalube 438L | 1.35 | — | — | 1.5 | 50.7 |
| 2 | Lowinox CPL | 0.075 | Naugalube 438L | 1.425 | — | — | 1.5 | 54.0 |
| 3 | Lowinox CPL | 0.225 | Naugalube 438L | 1.275 | — | — | 1.5 | 48.4 |
| 4 | Lowinox CPL | 0.15 | Naugalube 438L | 1.2 | Naugalube 531 | 0.15 | 1.5 | 43.6 |

The disclosures of all patents, articles and other materials described herein are hereby incorporated, in their entirety, into this specification by reference. The principles, preferred embodiments, and modes of operation of the present invention have been described in the foregoing specification. The invention is not to be construed as limited to the particular embodiments disclosed in the specification, since the disclosed embodiments are regarded as illustrative rather than limiting. Changes can be made by those skilled in the art without departing from the spirit or scope of the claimed invention.

What is claimed is:

1. A lubricant composition, comprising:

(a) a Group II and/or Group III base stock of lubricating viscosity; and (b) from 0.5 to 1.5% by weight based on the weight of the lubricant composition of an antioxidant composition consisting of a first antioxidant which is a reaction product of p-cresol with dicyclopentadiene and isobutylene and having a molecular weight [g/mol] of 600-700, and a second antioxidant having the formula:

$$(R_3)_a—Ar_1—NH—Ar_2—(R_4)_b$$

wherein $Ar_1$ and $Ar_2$ are independently aromatic hydrocarbon groups and $R_3$ and $R_4$ are independently hydrogen or hydrocarbyl groups having from 6 to about 100 carbon atoms and a and b are independently 0 to 3 but (a+b) is not greater than 4 wherein the weight ratio of the second antioxidant to the first antioxidant is from 1:1 to 19:1, wherein at least 80% by weight of the lubricant composition is base stock a).

2. The lubricant composition of claim 1, wherein the weight ratio of the second antioxidant to the first antioxidant is from 3:1 to 19:1.

3. The lubricant composition of claim 1, wherein the lubricant composition comprises ZDDP in an amount no greater than 1 wt.%, based on the total weight of the lubricant composition.

4. The lubricant composition of claim 1, wherein the lubricant composition comprises less than 0.7 wt.% ZDDP, based on the total weight of the lubricant composition.

5. The lubricant composition of claim 1, further comprising at least one lubricating oil additive selected from the group consisting of antioxidants, anti-wear agents, detergents, rust inhibitors, dehazing agents, demulsifying agents, metal deactivating agents, friction modifiers, pour point depressants, antifoaming agents, co- solvents, package compatibilisers, corrosion-inhibitors, ashless dispersants, dyes, extreme pressure agents and mixtures thereof.

6. The lubricant composition of claim 1, wherein the second antioxidant comprises a mixture of mono-, di- and trinonyl diphenylamine.

7. The lubricant composition of claim 1, wherein the antioxidant composition is a liquid at 25° C.

8. The lubricant composition of claim 1, wherein the antioxidant composition has a kinematic viscosity at 100° C. of less than 40 cSt.

9. The lubricant composition of claim 1, wherein the composition comprises hindered phenolics of formula (III) in an amount less than 0.5 weight percent, based on the total weight of the antioxidant composition:

(III)

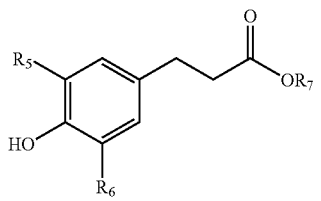

wherein R5, R6, and R7, the same or different, represent a linear or branched C1-C18 alkyl group.

* * * * *